US008443907B2

(12) United States Patent
Mickey

(10) Patent No.: US 8,443,907 B2
(45) Date of Patent: May 21, 2013

(54) APPARATUS AND METHOD FOR SEALING PORTIONS OF A WELLBORE

(75) Inventor: Clint Mickey, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 292 days.

(21) Appl. No.: 12/813,836

(22) Filed: Jun. 11, 2010

(65) Prior Publication Data

US 2011/0303421 A1 Dec. 15, 2011

(51) Int. Cl.
*E21B 33/12* (2006.01)

(52) U.S. Cl.
USPC ..... 166/387; 166/195; 166/191; 277/605; 277/645

(58) Field of Classification Search
USPC .. 166/387, 127, 188, 191, 195, 181; 277/605, 277/645
See application file for complete search history.

(56) References Cited

U.S. PATENT DOCUMENTS

| | | | | | |
|---|---|---|---|---|---|
| 49,599 | A | * | 8/1865 | Sicouret | 277/340 |
| 2,144,026 | A | * | 1/1939 | Park | 277/340 |
| 3,385,367 | A | * | 5/1968 | Kollsman | 166/191 |
| 5,195,583 | A | | 3/1993 | Toon et al. | |
| 6,142,227 | A | * | 11/2000 | Hiorth et al. | 166/123 |
| 6,581,682 | B1 | | 6/2003 | Parent et al. | |
| 2004/0007829 | A1 | * | 1/2004 | Ross | 277/626 |

OTHER PUBLICATIONS

Mota, et al. "Drilling in with expandable liner hangers". Expandables & Tubular Technology. Jun. 2006. 2 pages.

* cited by examiner

*Primary Examiner* — Nicole Coy
(74) *Attorney, Agent, or Firm* — Cantor Colburn LLP

(57) ABSTRACT

An apparatus for controlling fluid flow in a borehole in an earth formation includes: a carrier configured to be deployed in the borehole; and a sealing device including at least one deformable element disposed at the carrier, the deformable element configured to have a first position and a second position, the first position forming a void in the sealing device configured to retain a flowable sealing material therein, the second position causing the void to be in flowable communication with leak paths formed in at least one of the sealing device and the borehole.

19 Claims, 4 Drawing Sheets

APPARATUS AND METHOD FOR SEALING PORTIONS OF A WELLBORE

BACKGROUND

In the drilling and completion industry and for example in hydrocarbon exploration and recovery operations, efforts to improve production efficiency and increase output are ongoing. Some such efforts include preventing undesired fluids or other materials from entering a production borehole or certain portions of a borehole.

Downhole packer systems can be employed in an attempt to, for example, prevent entry of unwanted materials into a production flow or define selected production or fracture zones. Due to material expansion in the packers and discontinuities in casing materials or a borehole wall, leakage spaces may form in a packer or between the packer and a casing or borehole wall. Such leakage spaces can compromise the seal formed by such packers.

SUMMARY

An apparatus for controlling fluid flow in a borehole in an earth formation includes: a carrier configured to be deployed in the borehole; and a sealing device including at least one deformable element disposed at the carrier, the deformable element configured to have a first position and a second position, the first position forming a void in the sealing device configured to retain a flowable sealing material therein, the second position causing the void to be in flowable communication with leak paths formed in at least one of the sealing device and the borehole.

A method of controlling fluid flow in a borehole in an earth formation includes: deploying a fluid flow apparatus in a borehole, the fluid flow apparatus including a carrier and a sealing device, the sealing device including at least one deformable element disposed at the carrier, the deformable element configured to have a first position and a second position, the first position forming a void in the sealing device configured to retain a flowable sealing material therein; and actuating the sealing device to move the deformable member from the first position to a second position, the second position causing the void to be in flowable communication with leak paths formed in at least one of the sealing device and the borehole and causing the sealing material to flow into the leak paths.

BRIEF DESCRIPTION OF THE DRAWINGS

The following descriptions should not be considered limiting in any way. With reference to the accompanying drawings, like elements are numbered alike.

DETAILED DESCRIPTION

The apparatuses, systems and methods described herein provide for sealing a borehole in an earth formation. A sealing apparatus such as a packer includes at least one deformable element that forms a void within the sealing assembly within which a flowable bridging agent or sealing material may be disposed. The sealing assembly is configured so that, upon compression or actuation, the void is caused to be in flowable communication with an exterior of the sealing assembly and/or within spaces formed in the sealing assembly. In one embodiment, the void closes or reduces in volume to force the bridging agent into any leakage paths that may form within the sealing apparatus and/or between the sealing apparatus and the borehole wall. In one embodiment, the deformable element is a resilient member configured to deform in response to an axial compressive force and extend radially outwardly to expand the sealing apparatus toward a borehole wall. At least one compressible sealing component is disposed adjacent to the resilient member and is configured to radially expand in response to the compressive force to seal a portion of the borehole.

Figure 1:
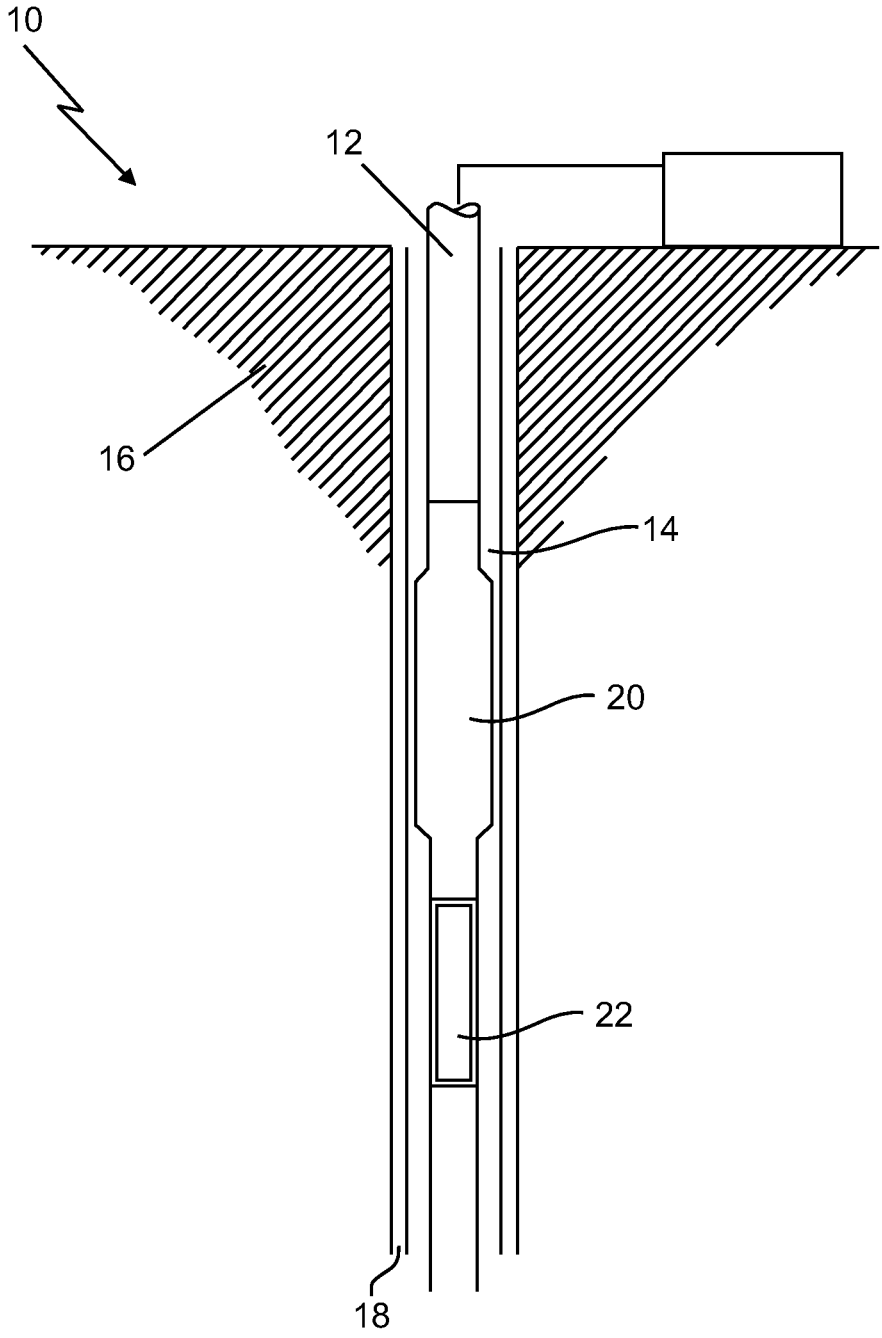
FIG. 1 is a cross-sectional view of an embodiment of a subterranean well drilling, well logging, evaluation, exploration and/or production system.

Referring to FIG. 1, an exemplary embodiment of a subterranean well drilling, well logging, evaluation, exploration and/or production system 10 includes a borehole string 12 such as a production string or a drillstring that is shown disposed in a borehole 14 that penetrates at least one earth formation 16 during a subterranean operation. In one embodiment, the borehole 14 is a cased borehole and includes a casing 18. The borehole string 12 includes a sealing apparatus or sealing assembly 20 such as a packer sub. In one embodiment, the borehole string 12 includes a downhole tool 22 such as a logging or measurement tool. The sealing assembly 20 is shown in FIG. 1 as connected to the borehole string 12, but is not limited thereto, and may be disposed with any suitable carrier.

Figure 2:
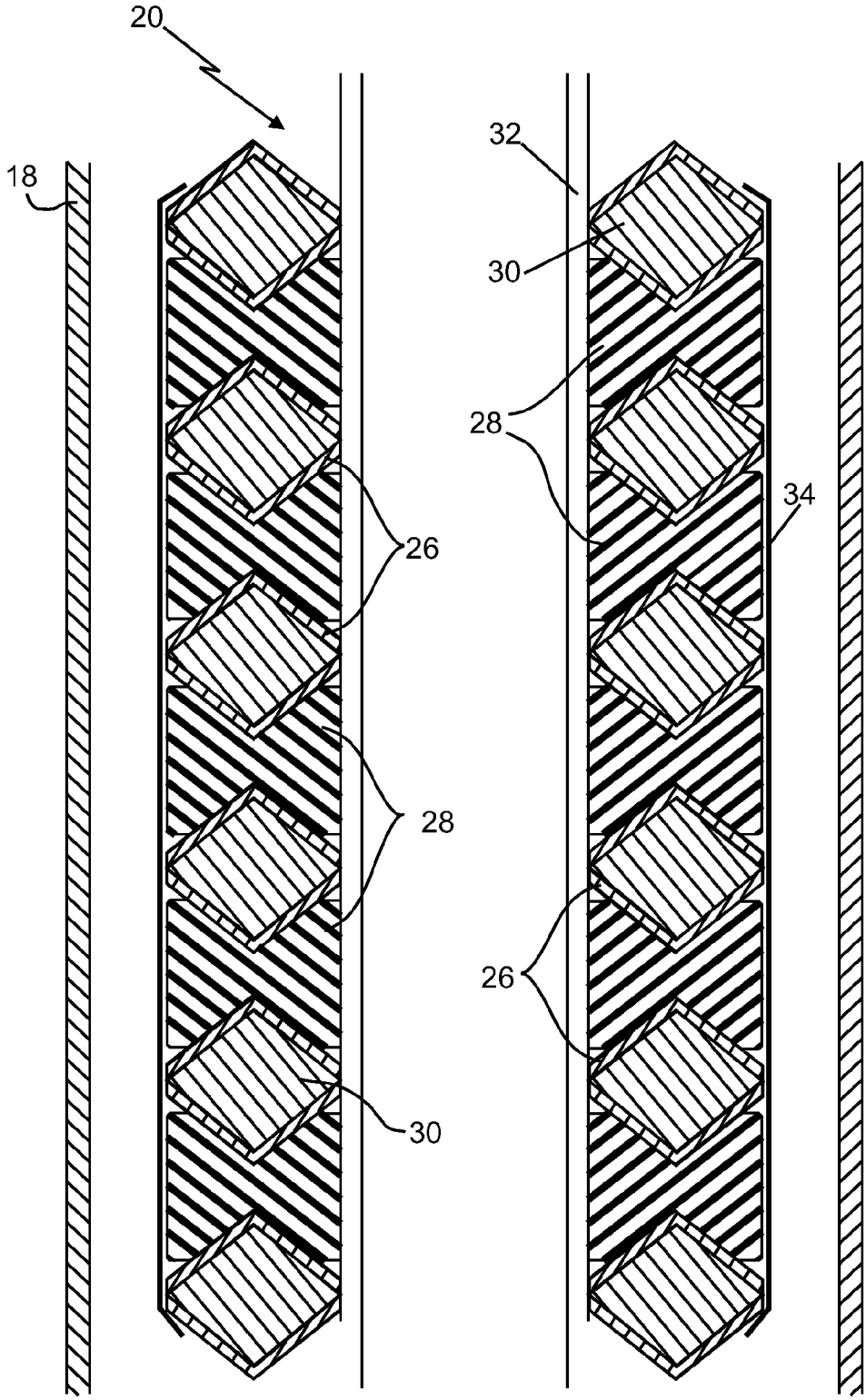
FIG. 2 is a cross-sectional view of a sealing apparatus of the system of FIG. 1 in a first position.
Figure 3:
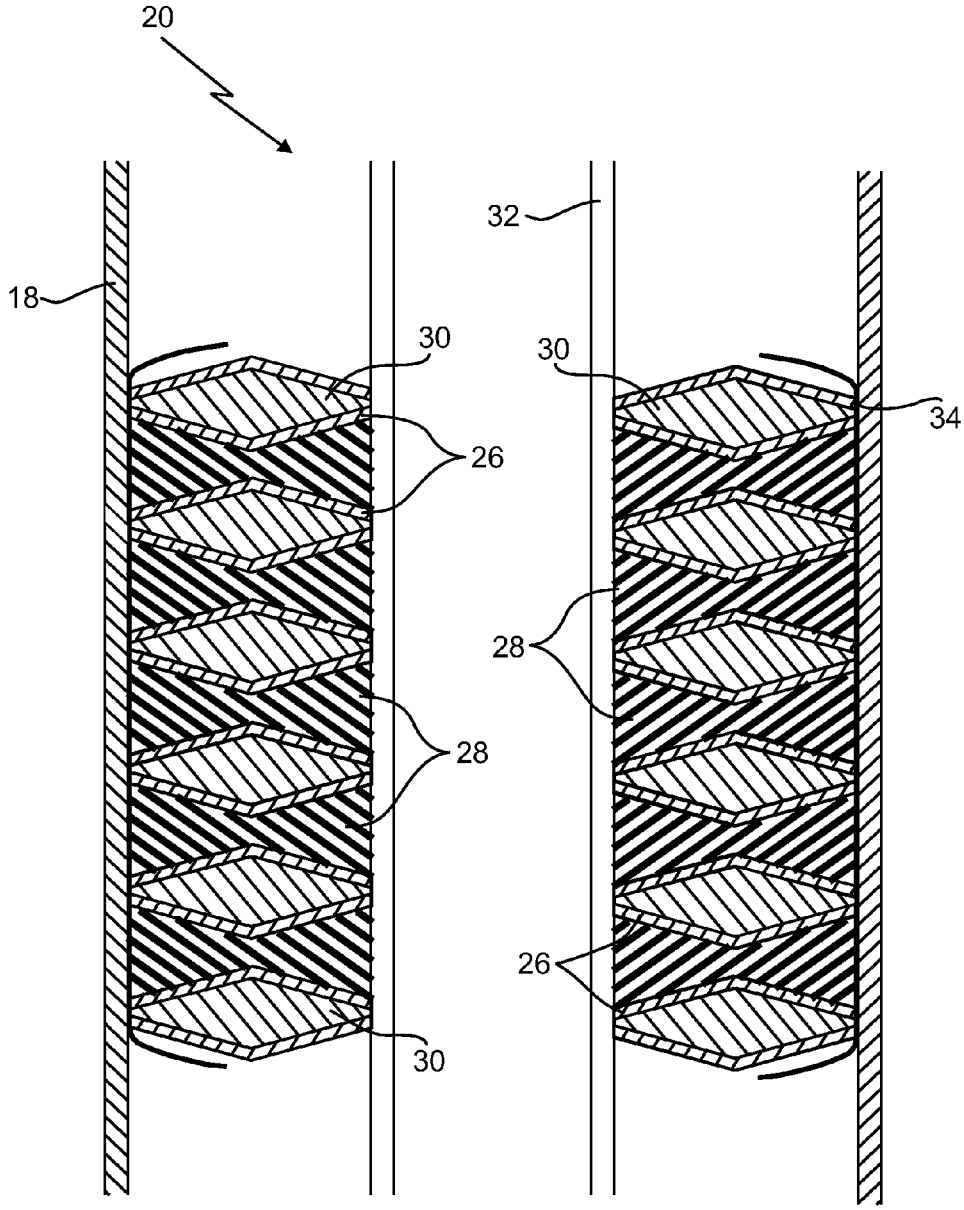
FIG. 3 is a cross-sectional view of a sealing apparatus of the system of FIG. 1 in a second actuated position.

FIGS. 2 and 3 show a cross-section of a portion of the sealing assembly 20, which includes one or more voids 30 disposed therein. For example, the voids 30 are formed by one or more deformable elements 26 that define, in a first position, shown for example in FIG. 2, a volume sufficient to retain a flowable sealing material or bridging agent therein. The elements 26 also define a second deployed or actuated position in which the voids are in flowable communication with leak paths formed in the sealing assembly 20 and/or the borehole 14, so that the sealing material can flow into and seal off the leak paths. In one embodiment, the second position results in a closing or decrease in volume of the voids 30 to force the sealing material into leak spaces or paths. An example of the sealing assembly 20 in the second actuated position is shown in FIG. 3. Although FIG. 3 shows that the voids 30 have been reduced, the voids 30 could be reduced by any amount or substantially or completely closed.

The sealing material or bridging agent may include any fluid, flowable solid, cement or other viscous fluid material. Exemplary materials include particulate materials, sand, gravel, dust, borehole pack-off materials and/or other flowable solid materials. Other exemplary materials include viscous and/or setting materials, such as epoxies, thermosetting materials and chemically setting materials. "Setting" refers to hardening or otherwise increasing in viscosity due to time or exposure to certain conditions. In the instance that an epoxy or chemically setting material is used, for example, multiple voids 30 may be configured to contain different parts of the material, and cause the parts to be ejected from the voids 30 upon compression or other actuation to mix the parts and cause the material to set.

Figure 4:
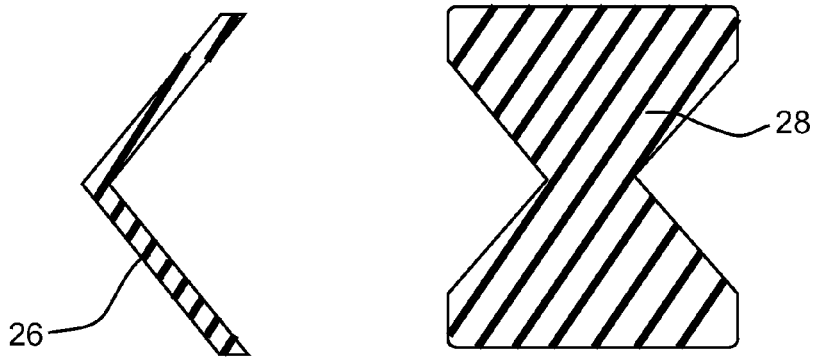
FIG. 4 is a cross-sectional view of a spring and a sealing component of the sealing apparatus of FIG. 2.

In one embodiment, the deformable elements 26 include one or more deformable, elastic and resilient members 26 such as one or more springs 26 disposed adjacent to or against one or more compressible sealing components 28. In one embodiment, the sealing assembly 20 includes a plurality of sealing components 28, each of which is axially bounded by a spring 26. For example, the sealing assembly 20 includes a series of alternating springs 26 and sealing components 28 arranged axially relative to the borehole string, carrier and/or the borehole when deployed downhole. The springs 26 and the sealing components 28 are disposed so that one or more voids 30 are formed within the sealing assembly 20. Examples of a spring 26 and a sealing component 28 are illustrated in FIG. 4. As described herein, "axial" refers to a direction that is at least generally parallel to a central longitudinal axis of the borehole, borehole string and/or carrier. "Radial" refers to a direction along a line that is orthogonal to the longitudinal axis and extends from the longitudinal axis.

In the embodiment shown in FIGS. 2 and 3, each spring 26 is a toroidal member having a cross sectional shape configured to increase an outer diameter of the spring in response to an axial force. For example, each spring has a V-shaped cross-section configured to increase in radial length upon axial compression. The shape and configuration is not limited to those described herein, and may be any shape and/or configuration that provides resistance to a compressive axial force and/or increases in radial length in response to a compressive axial force. The springs 26 are made of any suitable metallic or other flexible and resilient material, such as a high elongation metal.

The sealing components 28 are made from a compressible material, such as a rubber, polymer, elastomer and/or thermoplastic material. Examples of such materials include elastomers such as nitrile and HNBR, and thermoplastic materials such as Teflon. In one embodiment, each sealing component 28 is an individually molded component configured to be disposed adjacent to a corresponding spring 26. In one embodiment, as shown in FIGS. 2-4, each sealing component 28 is shaped to coincide with the shape of an adjacent spring, so that any space between a spring 26 and an adjacent sealing component is at least substantially eliminated before and/or after axial compression. Each sealing component 28 is optionally bonded to one or more adjacent springs 26.

In one embodiment, the sealing assembly 20 includes an internal space or void 30 that is configured to be reduced in volume upon application of an axial force. In one embodiment, the sealing assembly 20 includes pairs of oppositely axially facing V-shaped springs 26 disposed in contact with each other and configured to form one or more voids 30 when the sealing assembly 20 is in an uncompressed or partially compressed state. A sealing component 28 is disposed against one or both sides of each pair of springs 26.

The void(s) 30 may be left empty or may carry a bridging agent that includes any flowable sealing material. When the sealing assembly 20 is compressed, the void(s) 30 close or reduce in volume, expelling at least a portion of the bridging agent out of the void(s) 30. The expelled bridging agent may fill in any leakage paths or other spaces that may form in the sealing assembly 20 and/or between the sealing assembly 20 and the borehole wall or casing 18.

In one embodiment, each spring 26 has a first uncompressed position in which the void 30 is formed therebetween. At the first position, the springs define an outer diameter of the sealing assembly 20. Upon application of an axial compressive force, each spring 26 compresses axially and expands radially, causing the outer diameter of the sealing assembly 20 to increase. In addition, movement from the first position to the second position causes the void 30 to decrease in volume or otherwise be eliminated. In one embodiment, if a bridging agent is disposed within the void 30, movement to the second position causes at least some of the bridging agent to be expelled from the void 30.

FIGS. 2 and 3 show an embodiment including a plurality of voids 30 positioned axially along the sealing assembly 20. However, the size, shape, number and position of the voids 30 is not limited to those described herein. For example, the sealing assembly 20 may include voids 30 positioned at one or both ends of the sealing assembly 20 or near the center of the sealing assembly 20. In one embodiment, the sealing assembly 20 is axially bounded by voids 30 which may contain, for example, cement or sand in an inactive condition. Application of a compressive force would cause the cement or sand to be expelled at the ends of the sealing assembly 20 and allow the cement or sand to set at the ends to further seal off the borehole 14.

In one embodiment, the sealing assembly 20 includes a support structure configured to retain the springs 26 and the sealing components 28 and allow for axial compression. For example, the support structure is a mandrel 32 (e.g., a packer mandrel). In one embodiment, the mandrel 32 includes an interior bore to allow fluid to flow therethrough and is connected to the borehole string 12. The springs 26 and the sealing components 28 may be anchored on the mandrel 32 and/or the borehole string 12, such as by a cone or collar. In one embodiment, the sealing assembly 20 is radially expanded by axially compressing the springs 26 and the sealing components 28 axially on the mandrel 32 or over a tapered cone. One or more of the springs 26 and the sealing components 28 may be optionally bonded to the mandrel 32 or other support structure. A compression mechanism such as a sliding collar, a hydraulic mechanism such as a hydraulic piston or a setting tool may be connected to the support structure and/or the borehole string 12 to exert axial force on the sealing assembly 20.

The springs 26 may be mounted on an exterior surface of the support structure and can have a size configured to contact the casing 18 or borehole wall upon compression to create a zero-extrusion gap. Alternatively, the springs 26 may have a size configured to create an outer diameter that is less than an interior diameter of the casing 18 or the borehole wall, for example, to allow for pack-off. In one embodiment, the springs 26 may have varying sizes to provide for a variable outer diameter of the sealing assembly 20 upon compression.

In one embodiment, a protective cover 34, such as an exterior sleeve or liner is disposed on an outer surface of the sealing assembly 20 to protect the sealing assembly components and/or to aid in retaining a bridging agent within the sealing assembly 20 during deployment of the sealing assembly 20 downhole. An example of the protective cover 34 is a Teflon shrink wrap.

The shapes and configurations described herein are exemplary and not limited to the shapes and configurations described herein. The springs and the sealing components may have any shape or configuration suitable to provide a void therein and increase in diameter in response to compression. In addition, the number of seals and spring can vary and may be dependent on, for example, desired compressed seal length.

Figure 5:
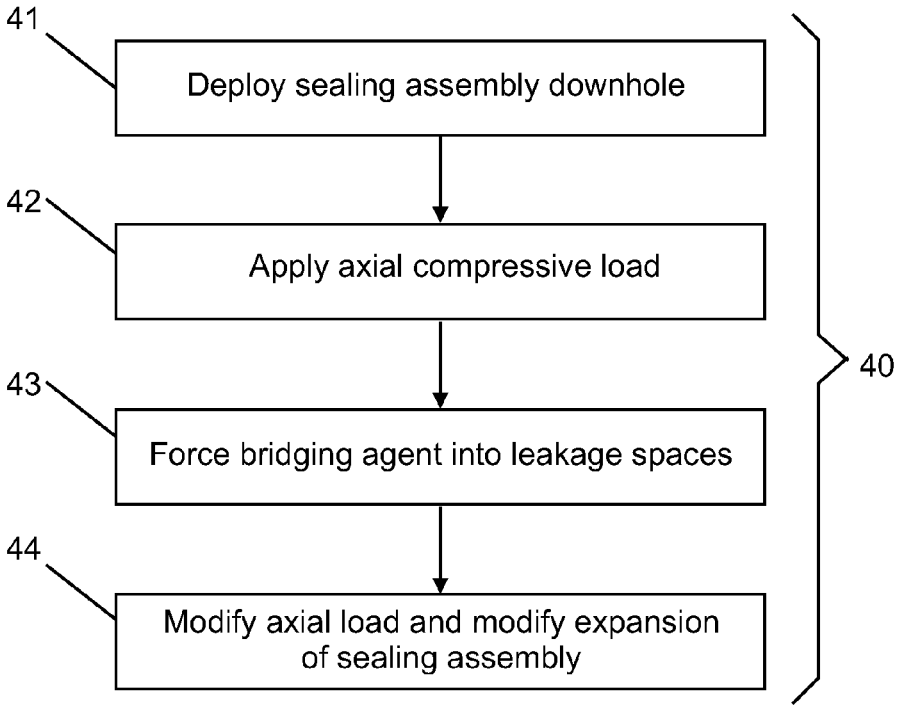
FIG. 5 is a flow diagram depicting a method of controlling fluid flow in a borehole.

FIG. 5 illustrates a method 40 of controlling fluid flow in a borehole in an earth formation. The method 40 includes one or more stages 41-44. In the first stage 41, the sealing assembly 20 is deployed downhole and advanced along the borehole 14 to a desired position, such as via a borehole string 12 or a wireline. In the second stage 42, an axial compressive load is applied to an end of the sealing assembly 20, or a differential pressure is applied to the sealing assembly 20, to force the springs 26 and the sealing components 28 to expand radially outward. In the third stage 43, in one embodiment, a bridging agent retained within voids 30 is forced into any spaces or leakage paths formed in the sealing assembly 20 and/or between the sealing assembly 20 and the borehole 14 in response to expansion of the sealing assembly 20. In the fourth stage 44, in one embodiment, axial compression exerted on the sealing assembly 20 is modified, due to operator action or pressure changes downhole, to cause the sealing assembly to further expand (in response to compression increases) or radially retract (in response to compression decreases).

The systems and methods described herein provide various advantages over existing processing methods and devices, by providing a packer or other sealing device that efficiently seals off a selected portion of a borehole. In addition, the sealing device may be used to retain a bridging mechanism that is effectively deployed to seal any leakage paths during expansion of the sealing apparatus. In some embodiment, the springs described herein provide an additional sealing support in addition to the compressible sealing components, as well as providing a mechanism to apply a tighter seal in response to increases in downhole pressure.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

The invention claimed is:

1. An apparatus for controlling fluid flow in a borehole in an earth formation, comprising:

a carrier configured to be deployed in the borehole; and a sealing device including at least one deformable element disposed at the carrier, the deformable element configured to have a first position and a second position, the first position forming avoid in the sealing device configured to retain a flowable sealing material within the void, the second position causing a reduction in volume of the void that expels the flowable sealing material from the void so that the flowable sealing material is in flowable communication with leak paths formed in at least one of the sealing device and the borehole.

2. The apparatus of claim 1, wherein the deformable element is configured to move from the first position to the second position in response to an axial compressive force.

3. The apparatus of claim 2, further comprising at least one compressible sealing component disposed adjacent to the at least one deformable element, the sealing component configured to compress axially and expand radially in response to the axial compressive force.

4. The apparatus of claim 3, wherein the at least one compressible sealing component is made from a material selected from at least one of a rubber material, an elastomer and a thermoplastic material.

5. The apparatus of claim 2, wherein the at least one deformable element is at least one spring member having a radial length, the radial length increasing in response to the axial compressive force.

6. The apparatus of claim 5, wherein the at least one spring member is at least one v-shaped member.

7. The apparatus of claim 6, wherein the at least one v-shaped member includes at least one pair of axially oppositely facing v-shaped members configured to form the void therebetween.

8. The apparatus of claim 1, wherein the first position is a deployment position in which the deformable element is configured to allow the carrier to be advanced through the borehole, and the second position is an actuated position in which the deformable element is configured to provide a seal between the sealing device and a borehole wall.

9. The apparatus of claim 8, further comprising the flowable sealing material selected from at least one of a flowable solid material, sand, gravel, dust and a borehole pack-off material.

10. The apparatus of claim 1, wherein the carrier includes a support structure configured to retain the sealing device and provide an axial compressive force on the sealing device.

11. The apparatus of claim 10, wherein the support structure is selected from at least one of a mandrel and a conical structure.

12. A method of controlling fluid flow in a borehole in an earth formation, comprising:

deploying a fluid flow apparatus in a borehole, the fluid flow apparatus including a carrier and a sealing device, the sealing device including at least one deformable element disposed at the carrier, the deformable element configured to have a first position and a second position, the first position forming a void in the sealing device configured to retain a flowable sealing material within the void; and actuating the sealing device to move the deformable member from the first position to a second position, the second position causing a reduction in volume of the void that expels the flowable sealing material from the void so that the flowable sealing material is in flowable communication with leak paths formed in at least one of the sealing device and the borehole and causing the sealing material to flow into the leak paths.

13. The method of claim 12, wherein actuating includes axially compressing the sealing device to radially expand the sealing device, reduce the volume of the void and seal off a portion of the borehole.

14. The method of claim 13, wherein the sealing device includes at least one compressible sealing component disposed adjacent to the at least one deformable element, and axially compressing the sealing device causes the sealing component to compress axially and expand radially.

15. The method of claim 13, wherein the at least one deformable element is at least one spring member having a radial length, the radial length increasing in response to axial compression.

16. The method of claim 15, wherein the at least one spring member is at least one v-shaped member.

17. The method of claim 16, wherein the at least one v-shaped member includes at least one pair of axially oppositely facing v-shaped members configured to form the void therebetween.

18. The method of claim 12, wherein axially compressing the sealing device includes applying an axial force on the sealing device against a support structure configured to retain the sealing device.

19. The method of claim 18, wherein the support structure is selected from at least one of a mandrel and a conical structure.

* * * * *